United States Patent [19]

Schmid

[11] Patent Number: 4,749,194

[45] Date of Patent: Jun. 7, 1988

[54] SECTIONAL CUTTING MACHINE USED TO CUT CURVED GALLERY CROSS-SECTIONS TRUE TO PROFILE

[75] Inventor: Bernhard Schmid, Dudweiler, Fed. Rep. of Germany

[73] Assignee: Saarbergwerke Aktiengesellschaft, Fed. Rep. of Germany

[21] Appl. No.: 887,091

[22] PCT Filed: Oct. 24, 1985

[86] PCT No.: PCT/DE85/00412

§ 371 Date: Jun. 23, 1986

§ 102(e) Date: Jun. 23, 1986

[87] PCT Pub. No.: WO86/02697

PCT Pub. Date: May 9, 1986

[30] Foreign Application Priority Data

Oct. 26, 1984 [DE] Fed. Rep. of Germany ..... 3439228
Jun. 1, 1985 [DE] Fed. Rep. of Germany ..... 3519697

[51] Int. Cl.[4] ..... F21C 25/52
[52] U.S. Cl. ..... 299/71; 299/75
[58] Field of Search ..... 299/71, 73, 75, 76, 299/31; 405/138

[56] References Cited

U.S. PATENT DOCUMENTS

| | | | |
|---|---|---|---|
| 3,314,722 | 4/1967 | Webster | 299/75 |
| 3,442,554 | 5/1969 | Paul | 299/31 |
| 3,467,436 | 9/1969 | Pentith et al. | 299/75 |
| 3,979,151 | 9/1976 | Plummer | 299/71 X |
| 4,185,873 | 1/1980 | Bohnes et al. | 299/31 |
| 4,589,701 | 5/1986 | Beckmann et al. | 299/75 X |
| 4,615,565 | 10/1986 | Schupphaus | 299/75 |

FOREIGN PATENT DOCUMENTS

| | | | |
|---|---|---|---|
| 1261459 | 2/1968 | Fed. Rep. of Germany . | |
| 2160644 | 6/1973 | Fed. Rep. of Germany | 299/73 |
| 2543501 | 12/1976 | Fed. Rep. of Germany . | |
| 998059 | 7/1965 | United Kingdom | 299/75 |
| 609885 | 6/1978 | U.S.S.R. | 299/75 |

*Primary Examiner*—Stephen Novosad
*Assistant Examiner*—David J. Bagnell
*Attorney, Agent, or Firm*—James Creighton Wray

[57] ABSTRACT

Sectional cutting machine used to cut a curved gallery cross-section in underground mining and tunneling operations with cutting rollers arranged in a movable way in regard to the machine frame. The machine is characterized by the circumstance, that to cut the upper layer (10) and the gallery roof (11), an upper roller (2) configured as a frontal surface roller is used. The roller is moved on a support arm (4) along a rotation axis (6) which is parallel to the longitudinal axis of the machine. The lower layer is cut by a lower roller (3), configured as a lateral cutting roller with even front surfaces (9) of the roller bodies (8). This lower roller (3) is moved along a predetermined, even path, which is parallel to the gallery bed (17).

3 Claims, 1 Drawing Sheet

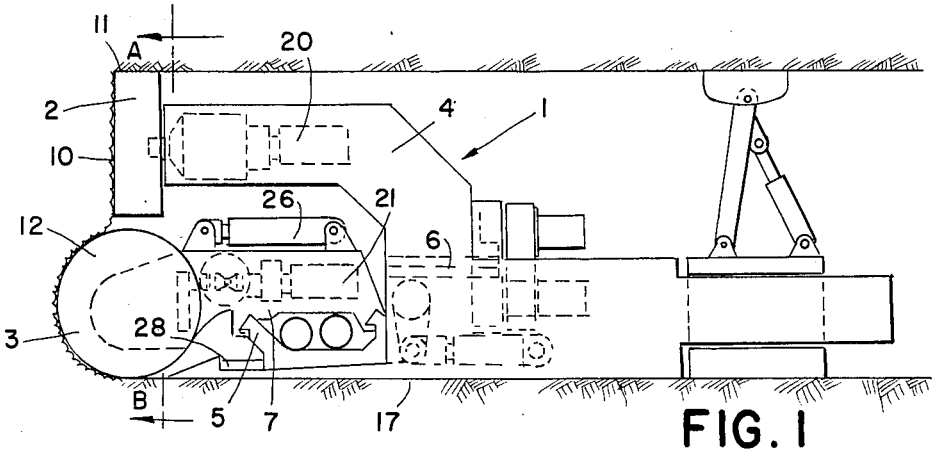
FIG. 1
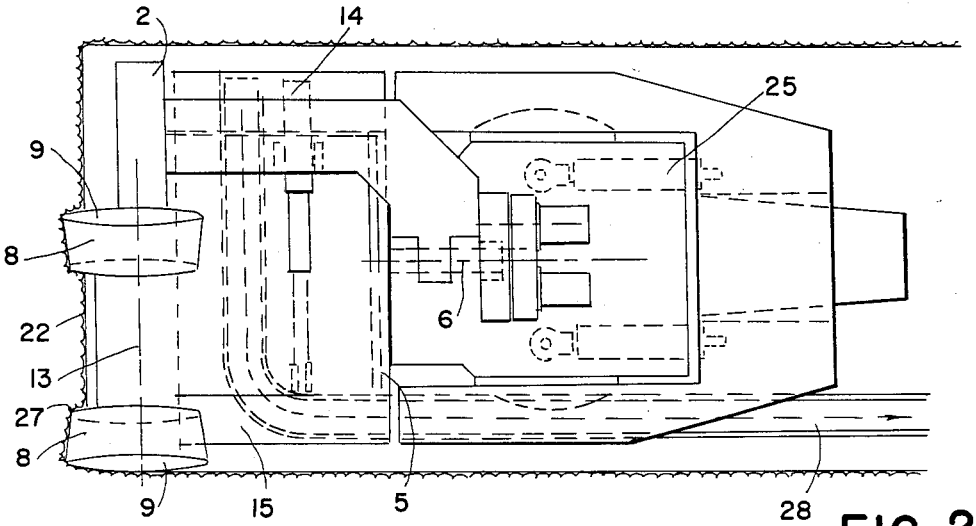
FIG. 2
FIG. 3
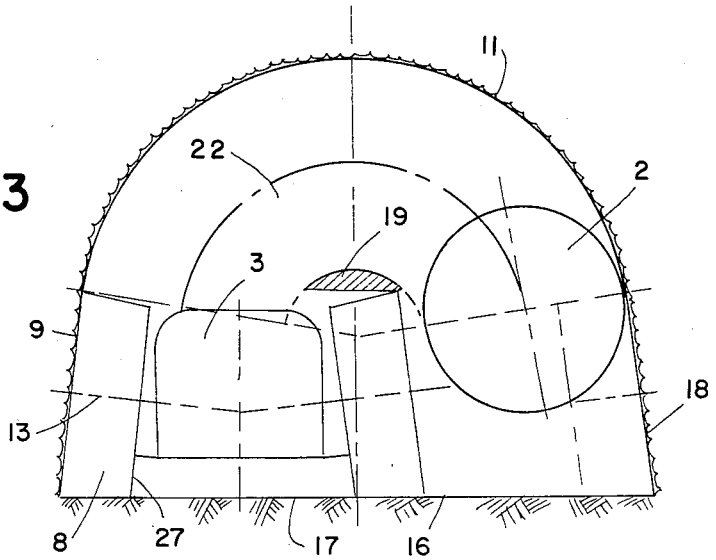

SECTIONAL CUTTING MACHINE USED TO CUT CURVED GALLERY CROSS-SECTIONS TRUE TO PROFILE

The invention regards a cutting machine for galleries, used to cut precision profiles on curved cross-sections in underground mining and tunneling operations by using cutting rollers which are movable in regard to the machine frame.

Shafts or excavation galleries in underground mining operations are preferably worked upon if they feature curved cross-sections, since the curved shape is best suited to support the high pressures of the bedrock or to accommodate the reduction of the cross-section (convergence) caused by the pressure of the bedrock. In cases such as these, it will be attempted to create inclined lateral gallery segments, that is to say, that the sides will be created at a slight angle in regard to the center of the gallery cross-section.

The mechanical excavation of such gallery profile shapes presently takes place with the aid of sectional cutting machines. These machines have a cutting head attached to the end of a boom, which, in turn, is attached to the sectional cutting machine itself, in such a way, that the entire surface of the gallery wall can be worked upon. The movement of the cutting boom is made possible with the aid of lifting and swivelling cylinders, which, due to kinematic reasons, attack at the machine end of the cutting base.

With boom sectional cutting machines, a so-called "overcuts" of the profile can not be avoided. This means, that, as a rule, the gallery cross-section will not be accurate in its profile contours, or that it will be cut with oversized dimensions, so that the gallery excavation cannot be made continuously flush to the rockbed. This circumstance makes it necessary to fill the gaps with mining mortar.

Consequently, it has been attempted to increase the profile cutting precision with the aid of complex mechanic or electronic profile section cutting controls and commands. However, so far, these attempts have not yet proven to be practical.

A further disadvantage of the boom sectional cutting machines consists in the length of the cutting boom necessary to cut the entire gallery cross-section, and in the arrangement of the lifting and swivelling cylinders at the machine end of the cutting boom, with the resulting unfavorably long levers. The long levers only allow relatively small forces to be applied to the cutting head. Consequently, boom cutting machines can only be equipped with so-called shaft bits. These bits, which mainly make grooves on the bedrock, have an insufficient life in abrasive secondary or country rock and also show unsatisfactory cutting performance characteristics.

The use of roller bits, which, due to their mode of operation, are also suited to loosen very hard rock, however, requires considerably higher forces, which cannot be exerted with boom cutting machines, since the range of application for these machines is restricted.

The task of the present invention consists in the development of a sectional cutting machine which will allow the precise cutting of a curved gallery roof profile, without additional auxiliary measures. This machine will also be able to be equipped in such a way, that it will increase the forward cutting action, such as with the use of roller bits on hard rock.

The task is solved in accordance to the invention by cutting the upper layer of the gallery roof profile with an upper roller configured as a frontal surface roller that moves on a support arm which can be swivelled along an axis that is parallel to the machine axis. The cutter for the lower layer will have a cross-cutting roller which is divided in two and it will further have even surfaces on the cutting side of the roller body. The lower cutting roller will move along a predetermined, even path which is parallel to the bed of the gallery.

The upper and the lower rollers are, thus, guided along predetermined planes of movement and only have simple, even movements. According to the invention, the use of separate cutting rollers with forced guidance, which are used to cut the upper layer into the shape of a curved gallery roof profile and the lower layer with straight lateral segments, makes it possible to cut the gallery cross-section in a simple manner, without the aid of complicated control and governing devices. The removed material can always be placed flush to the bedrock. Additional filling work is unnecessary.

If a gallery profile with inclined lateral sections has been selected (that is, with lateral sections which are not vertical to the bed), roller bodies with the shape of a truncated cone are used on the lower roller. The conical angles and the inclination angles of the axis of rotation in regard to the bed have been selected in such a way, that the forward moving frontal surface generates the prescribed inclination angle determined for the lateral profile in regard to the bed, while the lower generatrix will be parallel to the gallery bed.

While the upper roller must execute a swivelling motion along an axis that is parallel to the machine axis, the lower roller can be displaced along a straight path which is perpendicular to the longitudinal axis of the machine. This simple linear movement, in comparison to a possible swivelling movement along a vertical axis, has the advantage, that the wall will also be straight within the range of the lower layer and the lower roller, in regard to the upper roller, will not show too large a forward slip at the center of the gallery cross-section.

In a suitable way, the swivelling motion of the upper roller and the lateral movement of the lower roller will be implemented in opposing directions. This will permit to keep the surface of the curved segment remaining in the center of the wall (which remains uncut by either roller) within minimal proportions. Once the upper and lower rock layers have been cut, the rock of this uncut section loosens up by itself and does not present any difficulties.

The power drive for the lateral motion of the lower roller is advantageously implemented by hydraulic cylinders which have been placed within the range of the guided path and which attack immediately behind the cutting roller. In this way, due to the favorable lever conditions, the lower roller can also be equipped with roller bits, and, consequently, high pressures can be applied to the lower roller.

Due to the relatively short support arm length required, which creates a short lever length that is effective for the transmission of forces, the lower roller can also be equipped with roller bits, so that the sectional cutting machine according to the invention can be also used in hard, abrasive rock, and the cutting performance of the machine can simultaneously be considerably improved in comparison to existing sectional cutting machines.

The machine itself is built with small dimensions and is of lightweight construction. The strong forces to be applied at the cutting tools (roller bits) can not be supported by the machine's own weight (as it is the case with boom cutting machines). These forces must be absorbed in a familiar way by support cylinders and the forces are transferred to the bedrock through the same. This transmission of forces takes place with the aid of a temporary excavation such as, for example, with a knife shield, since in this case the collection of the excavated material is now possible to be effected parallel to the advance of the gallery.

The bracing system can be divided into two elements. Each partial system can be put under tension or relieved of tension independent of one another. Intermediate cylinders operating along the length of the gallery will move the machine in a familiar way, corresponding to the forward advance of the gallery. Also, the usual articulated joints have been provided, so that the machine can follow the predetermined changes in inclination, as well, as the directional changes within the gallery.

With a corresponding construction of the machine body and of the bracing system, the sectional cutting machine according to the invention offers additional advantages. Following the disassembly of the support arm, together with the upper roller, and the possible partial disassembly of the upper machine body, or of the bracing system, the machine can be used to cut a low door profile, so that, once a stratum gallery has been created, the machine will also be suited to cut the openings that follow the excavation sequence.

BRIEF DESCRIPTION OF THE DRAWINGS

FIG. 1 is a side elevation view of a preferred embodiment of the invention.

FIG. 2 is a top plan view of the FIG. 1 embodiment.

FIG. 3 is a cross-sectional view of a gallery cut by the FIG. 1 embodiment.

In the following, based on FIGS. 1 to 3, which show a schematic implementation example in greater detail, we will explain the sectional cutting machine according to the invention.

DETAILED DESCRIPTION OF THE DRAWINGS

FIGS. 1 to 3 show the sectional cutting machine 1 according to the invention with an upper roller 2 configured as a front surface roller and a lower roller 3 configured as a divided lateral cutting roller. The upper roller 2, as well as the roller body 8 of the lower roller 3, have also been equipped with bits at the circumference and on the frontal area, and the roller body 8 is additionally equipped with bits along the outside area 27 of the rear frontal area. The upper roller 2 has been configured in a swivelling manner (in regard to the inner machine body) with the aid of a support arm 4 that moves along a rotation axis 6 that is parallel to the longitudinal axis of the machine. During its swivelling motion, the upper roller cuts the upper layer 10 of the wall 22 into a curved gallery roof contour 11, which progresses tangentially into the lateral profile 18 cut by the lower roller.

The lower roller 3 that cuts the lower layer 12 with the lateral contour 18 is moved sideways with the help of a carriage 7 along a straight path 5, which is parallel to the gallery bed 17 and which is also perpendicular to the longitudinal axis of the machine. The power drive for the movement of the lower roller 3 is implemented by a hydraulic cylinder 14 located within the range of the guidance path 5, placed immediately behind the lower roller. The hydraulic cylinder is attached to the machine frame 15. Any other type of drive unit can also be used, such as, for example, a chain.

The roller bodies 8 of the lower roller have been configured as truncated cones, and the conical angle, as well, as the inclination angle of the rotational axes 13 in regard to the gallery bed have been determined in such a way, that the lower cone generatrix 16 of the roller bodies 8 are parallel to the gallery bed 17. On the other hand, the frontal surfaces 9 and the gallery bed 17 include the inclination angle provided for the lateral profile 18 of the gallery cross-section.

The power drive for the rotating movement of the upper 2 and lower roller 3 is implemented by separate drvies 20 and 21.

The swivelling movement of the upper roller 2 and the lateral motion of lower roller 3 along the cutting path are implemented in opposing directions, since in this way, the area 19 remaining in the center of the wall 22, which is not cut by the upper nor by the lower roller, can be kept minimal. The rock in this area breaks loose by itself after the upper 10 and the lower layer 12 have been cut and this rock does not present any problems. The loosened rock is removed by a transport device 28.

The sectional cutting machine is secured within the gallery in a familiar way by means of hydraulics. The advance of the machine in the direction of cutting is made possible by hydraulic cylinders 25, which have been arranged between the front and rear sections of the machine. During the advance movement of the machine, or during the cutting operation of the rollers into the wall, the rollers do not execute a swivelling motion nor a pushing motion, with the exception of the corrections necessary for the positioning of the same.

In order to be able to follow changes in the direction and inclination of the gallery to be worked on, articulated joints have been provided along a vertical and lateral axis between the front and rear machine frame sections. The lower roller 3 can also be lifted in regard to the machine housing by means of a cylinder 26.

I claim:

1. Partial cutting machine for the accurate cutting of a semicircular gallery profile in below ground mining and tunneling applications, comprising an upper head roller movable on a support arm along an axis that is parallel to the machine's longitudinal axis for cutting an upper bank within the gallery roof profile.

a lower roller, movable along a path parallel to the gallery floor, for cutting a lower bank, wherein the lower roller comprises two cross-cutting roller bodies rotatable about an axis substantially transverse to the axis of rotation of the upper lead roller and substantially transverse the machine's longitudinal axis, each roller body having the shape of a truncated cone which tapers toward the gallery center, the roller bodies having straight head attack surfaces, the lower surface lines of the roller bodies being parallel to the gallery floor, and the angle between the attach head surfaces and the gallery floor corresponding to a predetermined inclination angle between the lateral profile and the gallery floor.

2. Partial cutting machine according to claim 1, wherein the movement along the axis that is parallel to the machine's longitudinal axis is a swinging movement of the upper roller and the movement along a path parallel to the gallery floor is a crosswise movement of the lower roller, the swinging and crosswise movements are arranged in opposing directions.

3. Partial cutting machine according to claim 1 wherein the two roller bodies of the lower roller move linearly from side to side of the gallery while each roller body is angularly inclined with respect to the axis of linear movement.

* * * * *